US009512848B2

(12) United States Patent
Bottomfield

(10) Patent No.: US 9,512,848 B2
(45) Date of Patent: Dec. 6, 2016

(54) TURBINE CAP FOR TURBO-MOLECULAR PUMP

(75) Inventor: Roger L. Bottomfield, Gilbert, AZ (US)

(73) Assignee: Texas Capital Semiconductor, Inc., Chandler, AZ (US)

( * ) Notice: Subject to any disclaimer, the term of this patent is extended or adjusted under 35 U.S.C. 154(b) by 915 days.

(21) Appl. No.: 13/608,933

(22) Filed: Sep. 10, 2012

(65) Prior Publication Data

US 2014/0186169 A1 Jul. 3, 2014

Related U.S. Application Data

(60) Provisional application No. 61/534,785, filed on Sep. 14, 2011.

(51) Int. Cl.
*F04D 19/04* (2006.01)

(52) U.S. Cl.
CPC ..... *F04D 19/042* (2013.01)

(58) Field of Classification Search
CPC .... F04D 19/042; F04D 23/001; F04D 23/003; F04D 23/005; F04D 17/165; F04D 29/002; F04D 29/20; F04D 29/2216; F04D 29/2222; F04D 29/263; F04D 29/281; F04D 29/289; F04D 29/329
See application file for complete search history.

(56) References Cited

U.S. PATENT DOCUMENTS 303,558 A 8/1884 Campbell
2,043,412 A 6/1936 Klein
2,092,182 A 9/1937 Ray
2,434,896 A * 1/1948 Ayers ..... F04D 17/165 415/182.1
2,479,862 A 8/1949 Payne
2,685,380 A * 8/1954 Moeller ..... B65D 39/12 215/359
2,773,619 A 12/1956 Moeller
2,800,242 A 7/1957 Sauthoff
3,138,173 A 6/1964 Hartman
3,163,041 A * 12/1964 Karlby et al. ..... 73/861.94
(Continued)

FOREIGN PATENT DOCUMENTS

WO WO 94/07033 A1 3/1994

OTHER PUBLICATIONS

PCT International Search Report of PCT/US14/28065; dated Jul. 28, 2014.

(Continued)

*Primary Examiner* — Craig Kim
*Assistant Examiner* — Wayne A Lambert
(74) *Attorney, Agent, or Firm* — DLA Piper LLP

(57) ABSTRACT

A turbine assembly mounted to a pump rotor via mounting bolts. The turbine includes fins extending therefrom for pumping gasses and suspended particles from a semiconductor processing chamber. The tops of the bolts are recessed from the top surface of the turbine in a bolt cavity having an open end. A cap member is mounted over and seals the open end of the bolt cavity via a center bolt. The cap member has a shaped upper surface (conical, parabolic, squared, rounded) for deflecting particles away from the center of the turbine and toward the turbine's fins. The cap member's upper surface can include particle deflecting features such as fins, channels or asymmetric shapes to enhance particle deflection as the cap member rotates.

8 Claims, 5 Drawing Sheets

(56) References Cited

U.S. PATENT DOCUMENTS

| | | | | | |
|---|---|---|---|---|---|
| 3,168,978 | A | * | 2/1965 | Garnier et al. | 415/193 |
| 3,250,221 | A | | 5/1966 | Williams | |
| 3,291,156 | A | | 12/1966 | Corsano | |
| 3,321,221 | A | | 5/1967 | Harris et al. | |
| 3,335,895 | A | | 8/1967 | Santarelli | |
| 3,387,768 | A | * | 6/1968 | Zoehfeld | F04D 29/263 220/235 |
| 3,398,577 | A | * | 8/1968 | Kovats et al. | 73/861.94 |
| 3,434,656 | A | * | 3/1969 | Bellmer | F04C 29/023 417/371 |
| 3,435,771 | A | * | 4/1969 | Riple | 415/123 |
| 3,494,504 | A | | 2/1970 | Jackson | |
| 3,508,842 | A | * | 4/1970 | Lievens | 416/93 R |
| 3,613,936 | A | | 10/1971 | Kaiser et al. | |
| 3,618,809 | A | | 11/1971 | Martino | |
| 3,618,811 | A | | 11/1971 | Martino | |
| 3,639,074 | A | | 2/1972 | Killick | |
| 3,733,910 | A | | 5/1973 | Evans et al. | |
| 3,749,528 | A | * | 7/1973 | Rousseau et al. | 417/423.4 |
| 3,831,801 | A | | 8/1974 | Rodgers | |
| 3,877,546 | A | * | 4/1975 | Shrader | 184/6.18 |
| 3,998,245 | A | | 12/1976 | Martin | |
| 4,120,603 | A | * | 10/1978 | Downing | 415/11 |
| 4,203,535 | A | * | 5/1980 | Burnett et al. | 222/411 |
| 4,256,435 | A | * | 3/1981 | Eckel | F03D 1/0658 415/209.1 |
| 4,303,101 | A | | 12/1981 | Tholen | |
| 4,312,708 | A | * | 1/1982 | Leslie | G21C 13/067 138/89 |
| 4,426,190 | A | * | 1/1984 | Shapiro et al. | 415/74 |
| 4,493,344 | A | | 1/1985 | Mathison et al. | |
| 4,576,778 | A | | 3/1986 | Ferree | |
| 4,585,033 | A | | 4/1986 | Westman | |
| 4,729,491 | A | | 3/1988 | Jensen | |
| 4,753,070 | A | | 6/1988 | Werner | |
| 4,797,062 | A | * | 1/1989 | Deters et al. | 415/90 |
| 4,865,529 | A | * | 9/1989 | Sutton et al. | 417/409 |
| 5,059,092 | A | * | 10/1991 | Kabelitz et al. | 415/90 |
| 5,232,333 | A | * | 8/1993 | Girault | 415/58.5 |
| 5,528,618 | A | * | 6/1996 | Schlie et al. | 372/58 |
| 5,529,464 | A | | 6/1996 | Emerson et al. | |
| 5,577,883 | A | * | 11/1996 | Schutz et al. | 415/90 |
| 6,079,582 | A | | 6/2000 | Nickel et al. | |
| 6,109,887 | A | * | 8/2000 | Takura et al. | 417/348 |
| 6,461,123 | B1 | * | 10/2002 | Lotz | 417/423.4 |
| 6,513,549 | B2 | | 2/2003 | Chen | |
| 6,514,035 | B2 | * | 2/2003 | Iwane et al. | 415/72 |
| 6,662,490 | B1 | | 12/2003 | Aesch, Jr. | |
| 6,755,611 | B1 | * | 6/2004 | Kabasawa et al. | 415/90 |
| 7,464,727 | B1 | | 12/2008 | Larson | |
| 2009/0110563 | A1 | | 4/2009 | Takita et al. | |
| 2010/0074751 | A1 | | 3/2010 | Brown | |
| 2011/0189001 | A1 | | 8/2011 | Zhang et al. | |
| 2012/0291451 | A1 | | 11/2012 | Moehrle et al. | |

OTHER PUBLICATIONS

PCT Written Opinion of the International Searching Authority of PCT/US14/28065; dated Jul. 28, 2014.

* cited by examiner

TURBINE CAP FOR TURBO-MOLECULAR PUMP

RELATED APPLICATIONS

This application claims the benefit of U.S. Provisional Application No. 61/534,785, filed Sep. 14, 2011, and which is incorporated herein by reference.

FIELD OF THE INVENTION

The present invention relates to turbo-molecular pumps used for semiconductor manufacturing.

BACKGROUND OF THE INVENTION

Turbo-molecular pumps are used to draw gasses and suspended particles from chambers that are used to process semiconductor wafers. A conventional pump is illustrated in FIG. 1, and includes a turbine 10 mounted to a pump rotor 12 via mounting bolts 14. The turbine 10 includes fins 16 used to pump the gasses and suspended particles from the chamber (not shown). The tops of the bolts 14 are recessed from the top surface of the turbine 10 in a bolt cavity 18 that has an open end. This conventional design has worked dependably in the past for many years.

Recently, however, conventional pumps having this design have been found to require increased maintenance due to excessive residual process particulate in the wafer chamber, which can result in lower yields. It was discovered that the residual process particulate originates from particles that settle into the bolt cavity 18, and after a certain amount of time and accumulation, are emitted back into the chamber where they can contaminate the wafers being processed therein. This contamination has recently become more problematic because residual process particulate from the bolt cavity 18 are no longer tolerable in many present day wafer processing applications given the reduced process geometries.

There is a need for an improved turbine that prevents excessive residual process particulate.

BRIEF SUMMARY OF THE INVENTION

A turbine assembly includes a turbine with a bolt cavity formed into a top surface of the turbine and having an open end and a plurality of fins extending from the turbine, a plurality of bolts extending through the turbine for mounting the turbine to a pump rotor wherein tops of the plurality of bolts are recessed from the top surface in the bolt cavity, and a cap member mounted over and sealing the open end of the bolt cavity.

Other objects and features of the present invention will become apparent by a review of the specification, claims and appended figures.

DETAILED DESCRIPTION OF THE INVENTION

Figure 1:
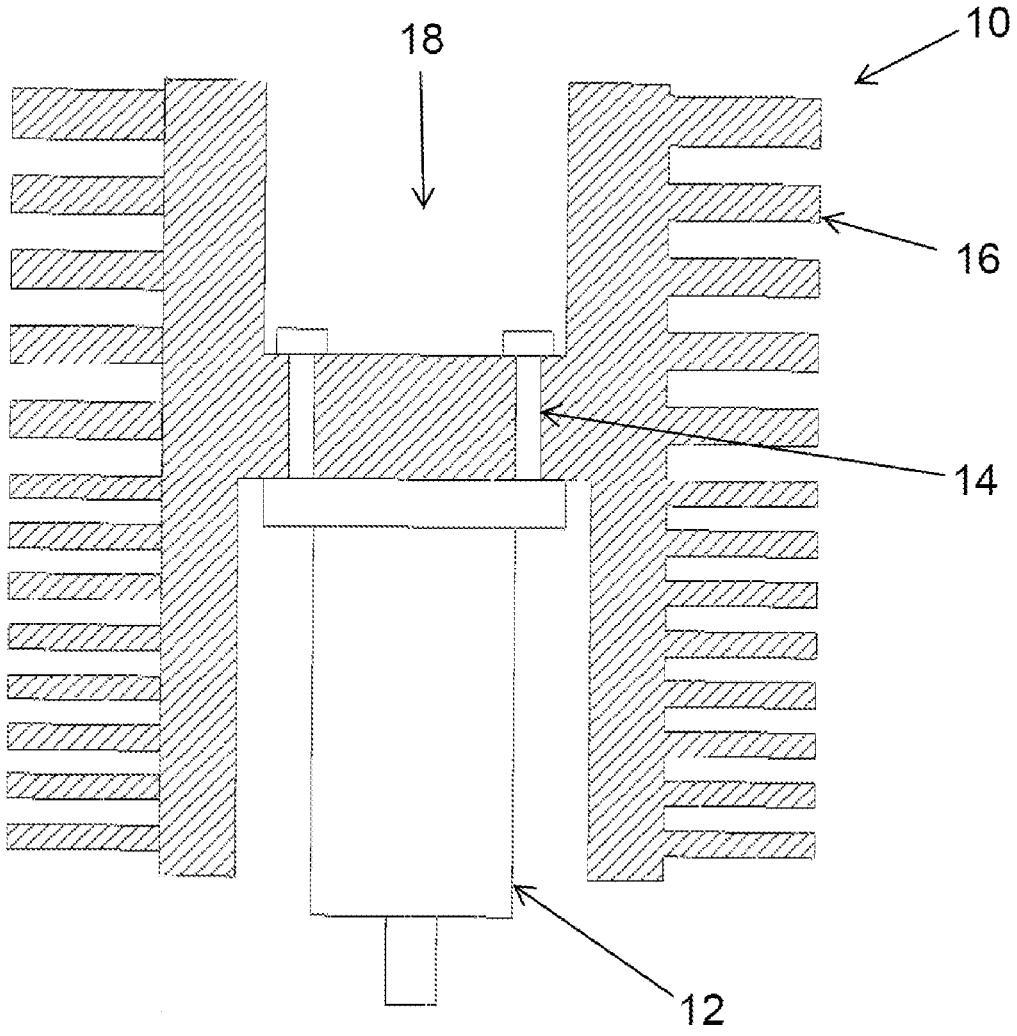
FIG. 1 (Prior Art)
FIG. 1 is a cross sectional side view of a conventional turbo-molecular pump.
Figure 2:
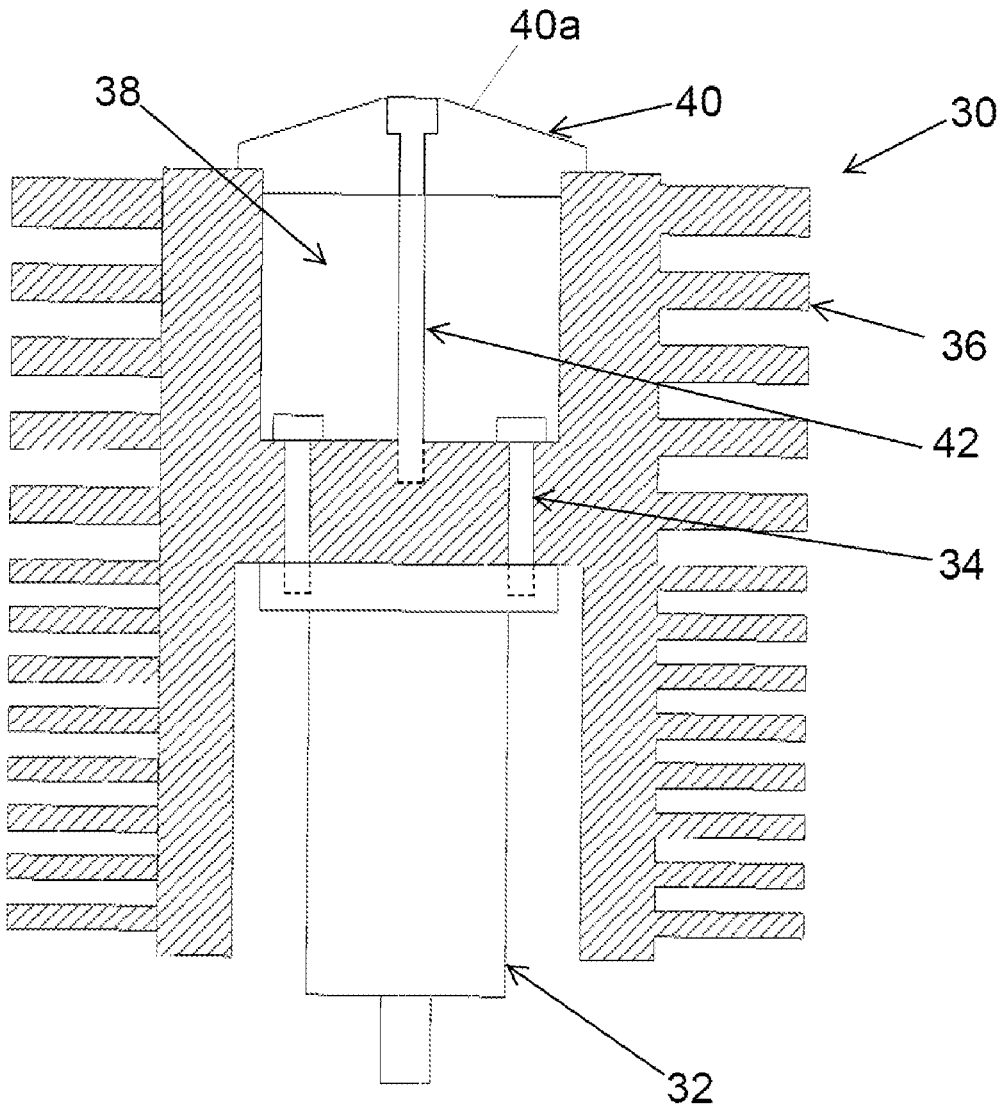
FIG. 2 is a cross sectional side view of the turbo-molecular pump of the present invention.

The present invention is an improved turbine 30 as illustrated in FIG. 2. Turbine 30 is mounted to a pump rotor 32 via mounting bolts 34. The turbine 30 includes fins 36 used to pump the gasses and suspended particles from the chamber (not shown). The tops of the bolts 34 are recessed from the top surface of the turbine 30 in a bolt cavity 38 that has an open end. A cap member 40 is mounted over and seals the open end of the bolt cavity 38. The cap member 40 is mounted to the turbine via a center bolt 42 with sufficient force to form a seal between cap member 40 and turbine 30. The cap member 40 serves two important functions. First, it prevents particles from settling into the bolt cavity 38, where they could later be expelled back into the chamber, and/or preventing any particles in bolt cavity 38 from being expelled out into the chamber. Second, cap 40 has a shaped upper surface 40*a* which deflects particles away from the center of the turbine and toward the turbine's fins, so that they can be more effectively evacuated from the chamber. Surface 40*a* is preferably cone-shaped (conically shaped), which deflects downwardly moving particles outwardly toward the turbine fins.

The inventive solution can be implemented on existing pumps without having to reconfigure the turbines therein. With the present invention, maintenance intervals can be lengthened due to reduced contamination from the bolt cavity.

Figure 3A:
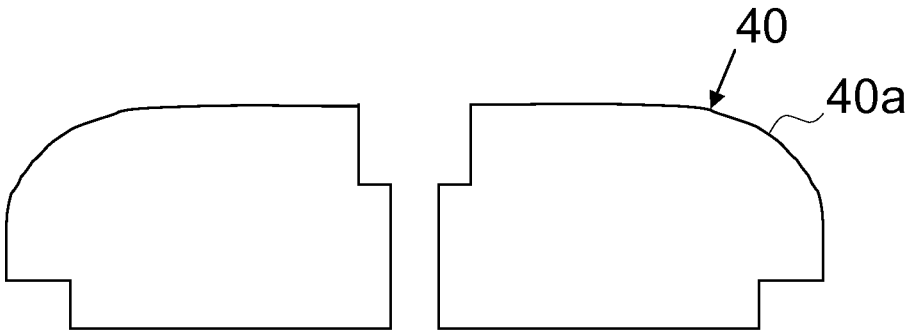
FIG. 3A is a cross sectional side view of the cap member with a parabolic shaped upper surface.
Figure 3B:
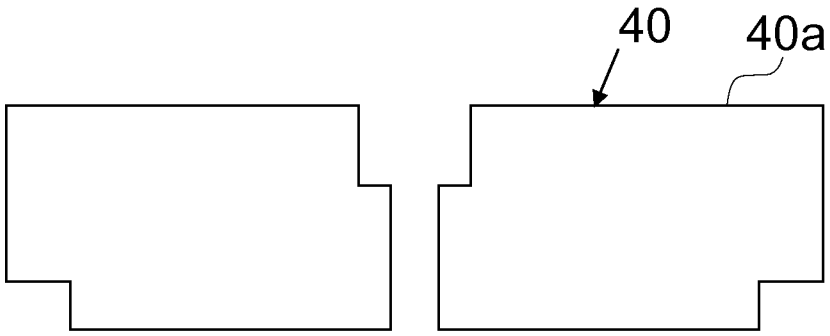
FIG. 3B is a cross sectional side view of the cap member with a squared shaped upper surface.
Figure 3C:
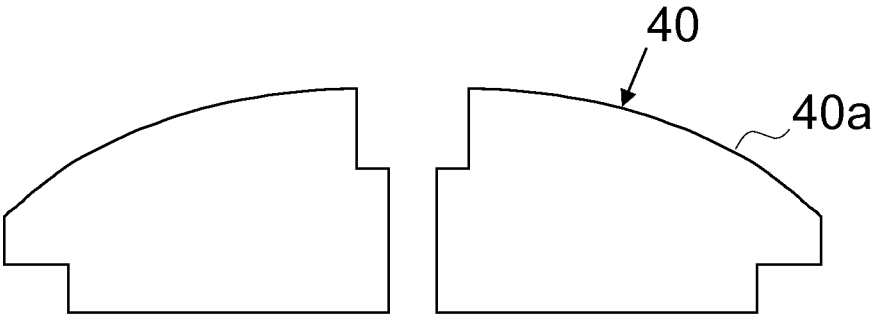
FIG. 3C is a cross sectional side view of the cap member with a rounded shaped upper surface.
Figure 4A:
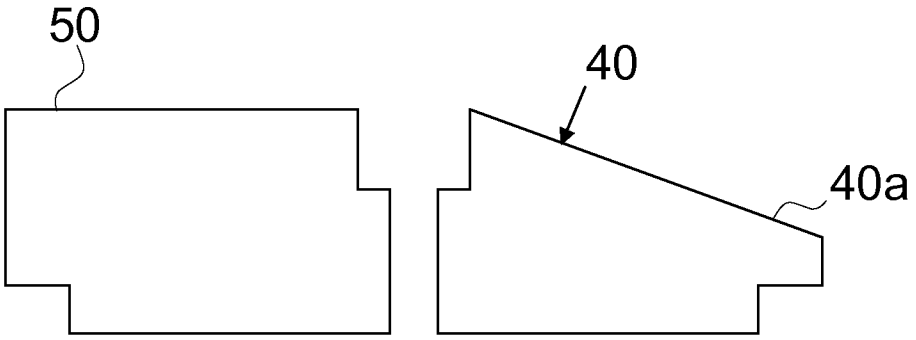
FIG. 4A is a cross sectional side view of the cap member with a fin on its upper surface.
Figure 4B:
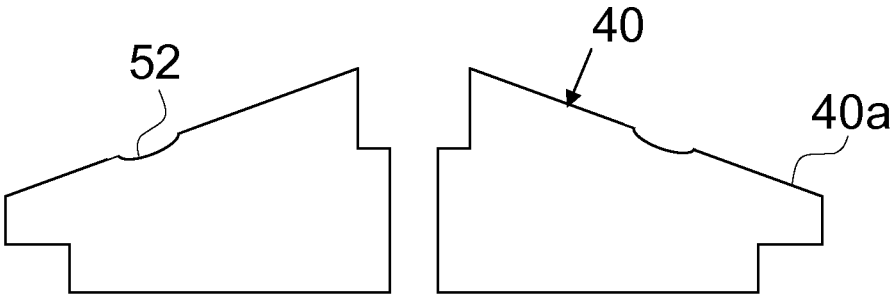
FIG. 4B is a cross sectional side view of the cap member with a channel on its upper surface.
Figure 4C:
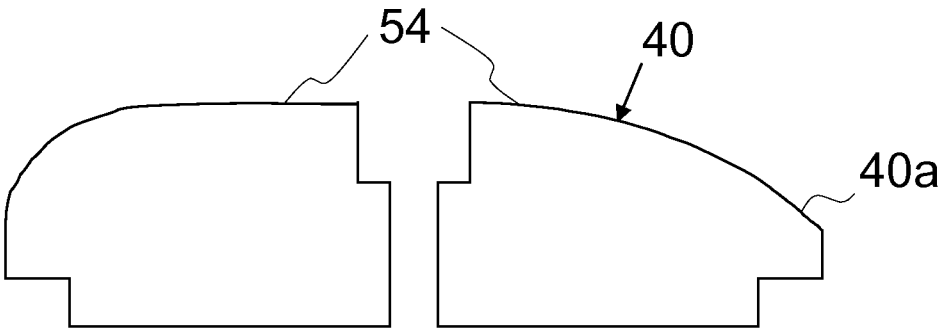
FIG. 4C is a cross sectional side view of the cap member with an asymmetric shaped upper surface.

Surface 40*a* could alternately have a shape other than conical to assist in deflecting particles and/or gasses outwardly, such as a parabolic, squared, or rounded, as illustrated in FIGS. 3A-3C, respectively, or any other appropriate convex shape. Additionally, since the cap member 40 is spinning with the turbine 30, particle deflecting features can be formed on the cap's upper surface, such as fins 50, channels 52, or asymmetric convex shapes 54, as illustrated in FIGS. 4*a*-4C, respectively, to enhance particle deflection as the cap member 40 rotates.

Figure 5A:
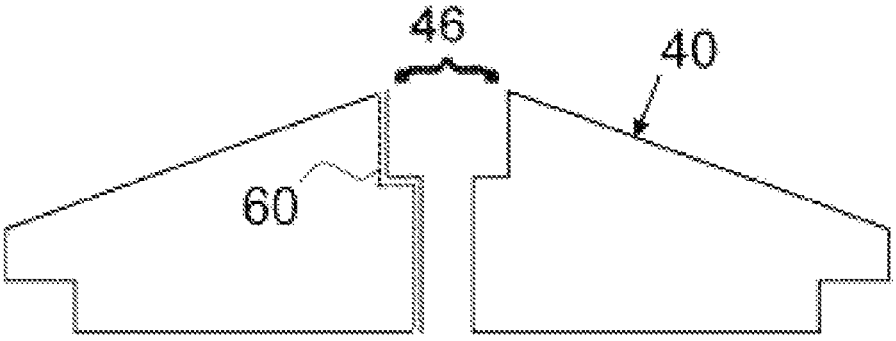
FIG. 5A is a cross sectional side view of the cap member with a vent channel along the center bolt aperture.
Figure 5B:
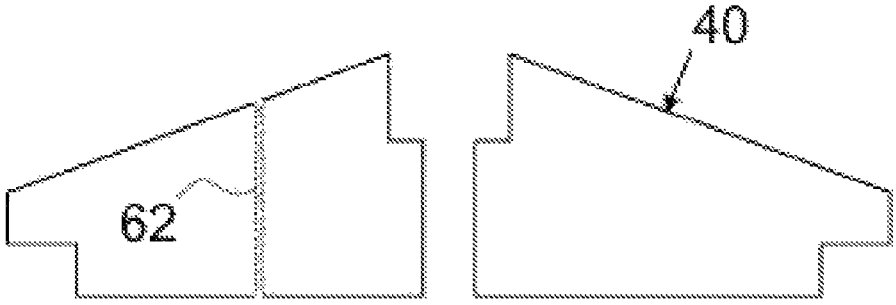
FIG. 5B is a cross sectional side view of the cap member with a vent channel extending therethrough.

Optionally, the bolt cavity 38 can be vented, to allow the cavity 38 to evacuate to high vacuum during operation in certain applications. The venting can be achieved by an open or closed channel formed in the cap. FIG. 5A illustrates a vent channel 60 as part of the center bolt aperture 46 through the cap member 40. FIG. 5B illustrates a vent channel 62 formed through the cap member 40.

Figure 6:
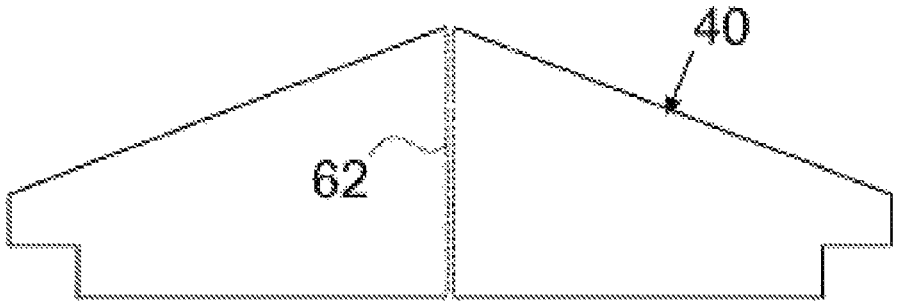
FIG. 6 is a cross sectional side view of the cap member with a vent channel extending therethrough without a center bold aperture (i.e. for friction fit).

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. Materials, processes and numerical examples described above are exemplary only, and should not be deemed to limit the claims. Lastly, cap member 40 could alternately be mounted to turbine 30 via a friction fit instead of by center bolt 42. For example, FIG. 6 illustrates a vent channel 62, without a center bolt aperture.

What is claimed is:

1. A turbine assembly, comprising:

a turbo molecular turbine that includes:

a bolt cavity formed into a top surface of the turbine and having an open end, and a plurality of fins extending from the turbine;

a plurality of bolts extending through the turbine for mounting the turbine to a pump rotor, wherein tops of the plurality of bolts are recessed from the top surface in the bolt cavity; and a turbo molecular turbine cap member mounted over and sealing the open end of the bolt cavity with a friction fit, wherein the cap member includes only a single hole which is a vent channel for venting air from the bolt cavity.

2. The turbine assembly of claim 1, wherein the turbo molecular turbine cap member has a conically shaped upper surface.

3. The turbine assembly of claim 1, wherein the turbo molecular turbine cap member has a parabolically shaped upper surface.

4. The turbine assembly of claim 1, wherein the turbo molecular turbine cap member has a squared shaped upper surface.

5. The turbine assembly of claim 1, wherein the turbo molecular turbine cap member has a rounded shaped upper surface.

6. The turbine assembly of claim 1, wherein the turbo molecular turbine cap member includes an asymmetrically shaped upper surface.

7. The turbine assembly of claim 1, wherein the turbo molecular turbine cap member includes a vent hole extending therethrough.

8. A turbine assembly, comprising:

a turbo molecular turbine that includes:

a bolt cavity formed into a top surface of the turbine and having an open end, and a plurality of bolts extending through the turbine for mounting the turbine to a pump rotor, wherein tops of the plurality of bolts are recessed from the top surface in the bolt cavity; and a cone shaped cap member mounted over and sealing the open end of the bolt cavity with a friction fit, wherein the cap member includes a vent channel, for venting air from the bolt cavity.

* * * * *